US009325113B2

(12) United States Patent
Pankau et al.

(10) Patent No.: US 9,325,113 B2
(45) Date of Patent: Apr. 26, 2016

(54) CONNECTOR ARRANGEMENT WITH SELF ALIGNING FEATURES

(71) Applicant: DELPHI INTERNATIONAL OPERATIONS LUXEMBOURG S.a.r.l., Bascharage (LU)

(72) Inventors: Harald Pankau, Furth (DE); Thomas Bernhard Pabst, Herzogenaurach (DE)

(73) Assignee: Delphi International Operations Luxembourg S.A.R.L., Luxembourg (LU)

( * ) Notice: Subject to any disclaimer, the term of this patent is extended or adjusted under 35 U.S.C. 154(b) by 2 days.

(21) Appl. No.: 14/362,655

(22) PCT Filed: Sep. 21, 2012

(86) PCT No.: PCT/EP2012/068613
§ 371 (c)(1),
(2) Date: Jun. 4, 2014

(87) PCT Pub. No.: WO2013/091920
PCT Pub. Date: Jun. 27, 2013

(65) Prior Publication Data

US 2014/0357114 A1 Dec. 4, 2014

(30) Foreign Application Priority Data

Dec. 23, 2011 (WO) ..... PCT/IB2011/003313

(51) Int. Cl.
*H01R 13/62* (2006.01)
*H01R 13/631* (2006.01)
(Continued)

(52) U.S. Cl.
CPC ..... *H01R 13/631* (2013.01); *H01R 13/6272* (2013.01); *H01R 13/639* (2013.01); *H01R 13/6315* (2013.01); *H01R 2201/26* (2013.01)

(58) Field of Classification Search
CPC . H01R 13/64; H01R 13/6456; H01R 13/6315
USPC ..... 439/372, 247, 314, 374, 153, 315
See application file for complete search history.

(56) References Cited

U.S. PATENT DOCUMENTS 4,239,325 A * 12/1980 Tyson ..... 439/314
4,802,861 A 2/1989 Gaston
(Continued)

FOREIGN PATENT DOCUMENTS

DE 202007017521 U1 9/2008
WO 88/10525 A1 12/1988
WO 2007/006335 A1 1/2007

OTHER PUBLICATIONS

International Search Report for PCT/EP2012/068613 published Nov. 2, 2012.
(Continued)

*Primary Examiner* — Vanessa Girardi
(74) *Attorney, Agent, or Firm* — Robert J. Myers

(57) ABSTRACT

The present invention relates to a connector arrangement including a plug connector and a socket connector that may be suited for use with an electronically adjustable damper of an automobile. The socket connector is rotatably arranged in a socket connector housing and has an outer casing. The outer casing includes a guideway formed therein that is configured to receive a corresponding guide element of the plug connector. The guideway has a funnel shaped portion configured to receive the guide element. The guide element rotates the socket connector into a correctly aligned orientation with regard to the plug connector upon contacting the funnel shaped portion when the plug connector is inserted into the socket connector.

14 Claims, 8 Drawing Sheets

(51) Int. Cl.
*H01R 13/627* (2006.01)
*H01R 13/639* (2006.01)

(56) References Cited

U.S. PATENT DOCUMENTS 4,867,523 A * 9/1989 Scott, Jr. ..... 385/60
5,718,596 A 2/1998 Inaba et al.
5,993,266 A * 11/1999 Mayer et al. ..... 439/680
6,296,508 B1 10/2001 Kuwahara
6,491,542 B1 12/2002 Zerebilov
7,241,056 B1 * 7/2007 Kuffel et al. ..... 385/60
7,530,953 B2 * 5/2009 Harshman et al. ..... 600/463
7,841,886 B2 11/2010 Klien
8,011,942 B2 * 9/2011 Ohmori et al. ..... 439/314
8,273,028 B2 * 9/2012 Harshman et al. ..... 600/463
2010/0178789 A1 7/2010 Ohmori

OTHER PUBLICATIONS

English Translation of DE202007017521 U1 (Machine Translated), published Sep. 25, 2008.

* cited by examiner

A

CONNECTOR ARRANGEMENT WITH SELF ALIGNING FEATURES

CROSS-REFERENCE TO RELATED APPLICATION

This application is a national stage application under 35 U.S.C. §371 of PCT Application Number PCT/EP2012/068613 having an international filing date of Sep. 21, 2012, which designated the United States, said PCT application claiming the benefit of PCT Application Number PCT/IB2011/003313, having an international filing date of Dec. 23, 2011, which also designated the United States, the entire disclosure of each of which are hereby incorporated herein by reference.

TECHNICAL FIELD OF THE INVENTION

The present invention relates to electrical connector arrangements having a connector and a counter connector, in particular a plug connector and a socket connector, with a self-alignment feature for aligning and connecting both connectors. The present invention relates in particular to connector arrangements for electrically adjustable dampers for automobiles.

BACKGROUND OF THE INVENTION

Machines and electrical devices commonly require the use of electrical connector arrangements comprising a male plug inserted into a female socket. Such electrical connector arrangements usually allow the device, or components of the device, to be disconnected from electrical power to allow disassembly, maintenance, or repair of the device.

Electrical connector arrangements for complex machinery may include a plurality of electrical pins on a male connector which mate with a corresponding plurality of pin sockets in a female counter connector. The male and the female connector are generally shaped or notched so that they can be connected in only one orientation to allow proper mating.

Thereto, WO 2007/006335 A1 discloses a connector arrangement for connecting a contact receptacle of a connector and a contact header of a counter connector. The connector arrangement includes locking means for maintaining the contact receptacle in an intermediate position into a frame of the connector, and unlocking means for releasing the contact receptacle from its intermediate position.

However, in some situations requiring electrical connector arrangements, the connector arrangement must be positioned in a location inaccessible to human sight.

Thereto, WO 1988/010525 discloses a self-aligning electrical connector arrangement for aligning and connecting multiple pins of a male coupler with the corresponding multiple pin sockets of a female coupler in a blind environment. A cylindrical standpipe is attached to and extends axially from the female connector. The end of the standpipe remote from the female coupler comprises a ramp sloping to a lug slot in the standpipe that extends toward the female coupler. The male coupler includes a lug comprising a cam follower or roller for following the cam of the standpipe.

However, this self-aligning electrical connector needs to be further improved for application fields, where the connector arrangement must be positioned in a location not only inaccessible to human sight, but also in a location hardly accessible to human reach. In such location, it must be further facilitated to correctly align and connect the connector arrangement, as it is hardly impossible to check the alignment visually and tactilely and it is further difficult to fiddle the connector into the counter connector. Obviously, such a connector is likewise very advantageous in normal situations, since the self-aligning facilitates and secures the mating process also in conditions, where the connector parts are easily accessible.

BRIEF SUMMARY OF THE INVENTION

It is an object of the present invention to provide an improved self-aligning connector arrangement for aligning and connecting a plug connector and a socket connector, preferably in an environment hardly accessible to human sight and reach.

According to the invention, it is provided a connector arrangement comprising a plug connector and a socket connector. In particular, it is provided a connector arrangement for an electronically adjustable damper of an automobile. According to the invention, the socket connector is rotatably arrangable in a socket connector housing and comprises an outer casing comprising at least one guideway formed therein for the reception of a corresponding guide element of the plug connector. The guideway has preferably an opening which facilitates the insertion of the guide element as in particular a funnel shaped portion for the reception of the guide element, so that upon insertion of the plug connector into the socket connector, the guide element is enabled upon contacting portions of the funnel shaped portion to rotate the socket connector into a correctly aligned orientation with regard to the plug connector. In other words, since the socket connector is arranged rotatable in a socket connector housing, it is upon insertion of the plug connector automatically rotated in the correct orientation to allow a correct mating with said plug connector.

The connector arrangement solves the object of the present invention, in particular as the socket connector is rotatably arrangable in a socket connector housing. Thereby, the plug connector can be held by the user in an arbitrary position and the rotatability of the socket connector will allow a rotation of the socket connector into the correctly aligned position. In other words, the user does not need to actively rotate or align the plug connector into a correctly aligned position before mating with the socket connector. Thereby, an environment hardly accessible to human sight and reach does not impair the alignment and the connection between the plug connector and the socket connector, as also a (compelled by the environment) nearly blind and clumsy user is able to insert the plug connector into the socket connector. Naturally, the present invention is also advantageous in normal conditions, where the user is not hampered by lack of sight or similar.

Preferably, an outer casing of the socket connector comprises at least one guideway with a funnel shaped portion for the reception of a corresponding guide element of the plug connector. Thereby, a slight and imprecise contact between the plug connector and the socket connector enables a guiding of the guide element of the plug connector along contacting portions of the funnel shaped portion of the guideway of the socket connector's outer casing. As a result, the plug connector is reliably guided into the socket connector independent of the initial position of the connectors to each other. Thereby, a safe connection of the two connectors is further independent from the environment and the abilities of the user.

This so-called self-alignment is preferably further improved by an essentially cylindrical plug-in portion of the plug connector adapted to be inserted into the socket connector. The guide element is then preferably arranged at the free end of the cylindrical plug-in portion. The self-alignment is preferably further improved by parabolic shaped faces of the funnel shaped portion of the guideway of the socket connector's outer casing.

In many fields of applications, it is important that a save coupling between two connectors can be guaranteed. Therefore, the connector arrangement according to the invention is preferably provided with a connector position assurance (CPA) member which can be inserted into a locked position only if the plug connector is appropriately connected to socket connector. In this locked position, the CPA provides additional security for the mated state of plug connector and the socket connector, and typically the CPA is constructed such that an operator can visibly detect if the CPA is inserted correctly into its locked position.

For the above discussed self-alignment, the plug connector is preferably in locked position still arranged rotatable with respect to the socket connector housing. The CPA is preferably allocated to the plug connector and comprises a cylindrical outer cap and an inner locking member comprising at least one locking portion, for example in form of a locking arm. The cylindrical outer cap preferably comprises cylindrical side walls, an open end and a closed end. The socket connector housing preferably comprises a locking projection adapted to interact with the locking portion of the inner locking member, to allow a locking of plug connector and socket connector housing. The outer cap is arranged movable with respect to the inner locking member from a first open position to a second closed position. After the locking of the inner locking member with the socket connector housing, the cylindrical outer cap is movable to the second closed position, thereby preventing a release of the locking of the inner locking member. Preferably, the CPA can only be moved into the second position when the two connectors are fully mated, so that a correct and safe mating between the plug connector and the socket connector can be guaranteed.

The CPA can be further improved when the cylindrical outer cap comprises a latching member adapted to latch onto a latching portion of the inner locking member when the cap is arranged in the second closed position. Thereby, a correct and safe mating between the outer cap and the inner locking member can be further improved.

The form of the CPA can be flexibly adapted to the operational conditions. The inner locking member preferably allows a locking onto the socket connector housing in any relative angular orientation of plug connector and socket connector housing. Therefore, the locking projection of the socket connector housing can be provided in a ring shape, out of one circumferentially extending collar, out of several circumferentially spaced collar elements or the like.

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

FIGS. 1 to 8 show a connector arrangement comprising a plug connector 10 and a socket connector 20 from different angles. The socket connector 20 is configured to be rotatably arranged in a socket connector housing 21 (see FIGS. 7 and 8). The socket connector housing is e.g. part of an electronically adjustable damper arrangement if a passenger vehicle. Upon an arbitrarily insertion of the plug connector 10 into the socket connector 20, the socket connector 20 is rotated into a correctly aligned orientation with regard to the plug connector 10. This rotation is enabled and guided by the following constructive means.

Figure 1:
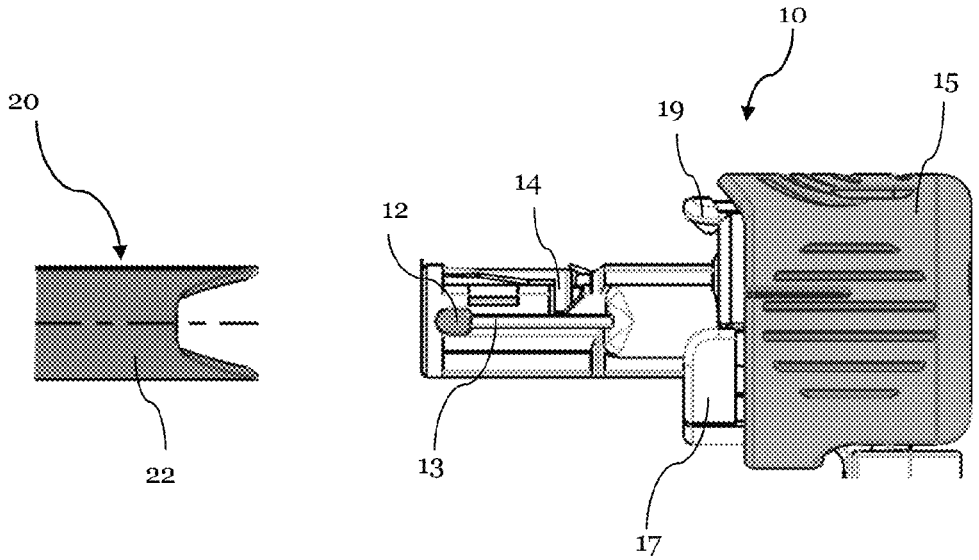
FIG. 1 shows a schematic illustration of a connector arrangement comprising a plug connector and a socket connector.

As shown in FIG. 1, the plug connector 10 comprises a cylindrical plug-in portion 13 with a guide element 12 at the free end of the cylindrical plug-in portion 13. The plug connector 10 further comprises a lever member 14 which serves as a terminal position assurance (IPA) member to verify the correct mounting of the contact terminals in the plug connector 10. If the terminals are not correctly mounted in plug connector 10, the lever member 14 cannot be closed, i.e. pushed in the position shown in the figures, so that a mating of the plug connector 10 is not possible. Thereby an incorrect mounting of the terminals is easily detected.

Figure 2:
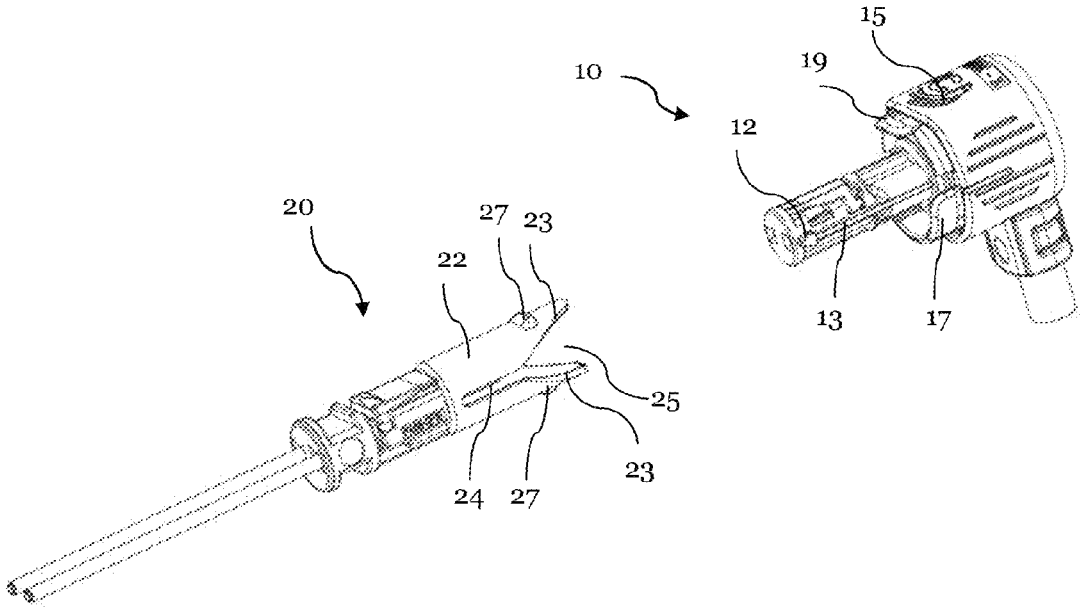
FIG. 2 shows a 3D illustration of a connector arrangement.
Figure 3:
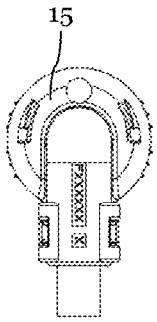
FIGS. 3-5 show several views of the plug connector.
Figure 4:
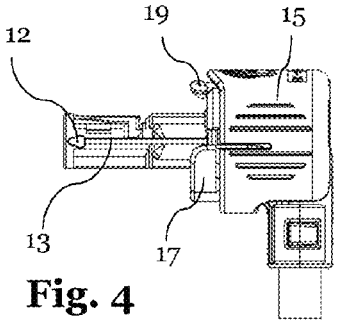
Figure 5:
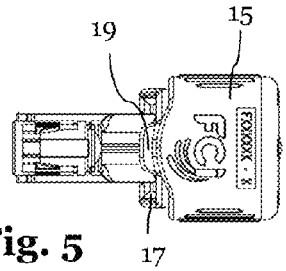
Figure 6:
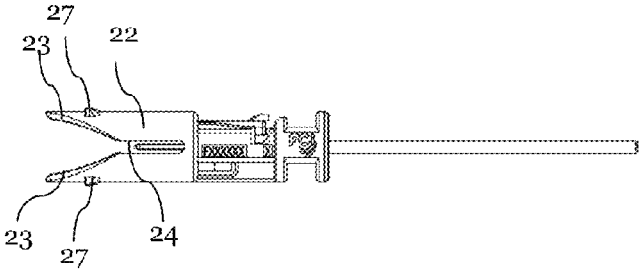
FIG. 6 shows a view of the socket connector.

As shown in FIG. 2, the socket connector 20 comprises an outer casing 22 with a guideway 24 for the reception of the guide element 12 of the plug connector 10. The guideway 24 has a funnel shaped portion 25 with contacting portions 23 for the reception of the guide element 12. The contacting portions 23 of the funnel shaped portion 25 are provided with a screw curved shape. The screw curve has preferably an essentially constant gradient so that the torque applied upon mating of plug connector 10 is constant. The socket connector 20 comprises two ledges 27 arranged spaced apart on the outer surface of the outer casing 22. The two ledges 27 are further explained concerning FIGS. 12 and 13. The plug connector 10 and the socket connector 20 with its constructive guiding means are further shown in FIGS. 3-6 in different perspectives to facilitate understanding.

Figure 7:
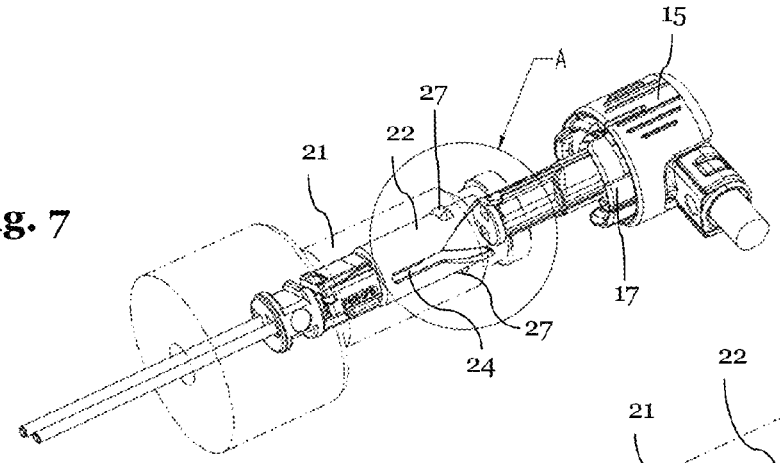
FIGS. 7 to 11 show several views of a course of action concerning the self-alignment during the insertion of the plug connector into the socket connector.
Figure 8:
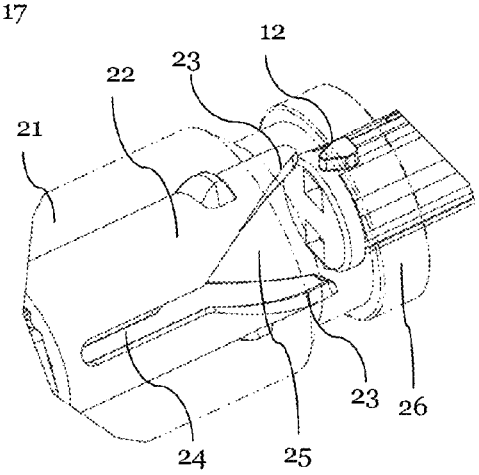

As shown in FIGS. 7 to 11, upon an arbitrarily insertion of the plug connector 10 into the socket connector 20, an imprecise contact between the plug connector 10 and the socket connector 20 enables a guiding of the guide element 12 of the plug connector 10 along contacting portions 23 of the funnel shaped portion 25 of the guideway 24 of the socket connector's 20 outer casing 22. In FIG. 7, the guide element 12 of the plug connector 10 is shown in an arbitrarily position right before a contact with the socket connector 20. FIG. 8 shows the same position in detail.

Figure 9:
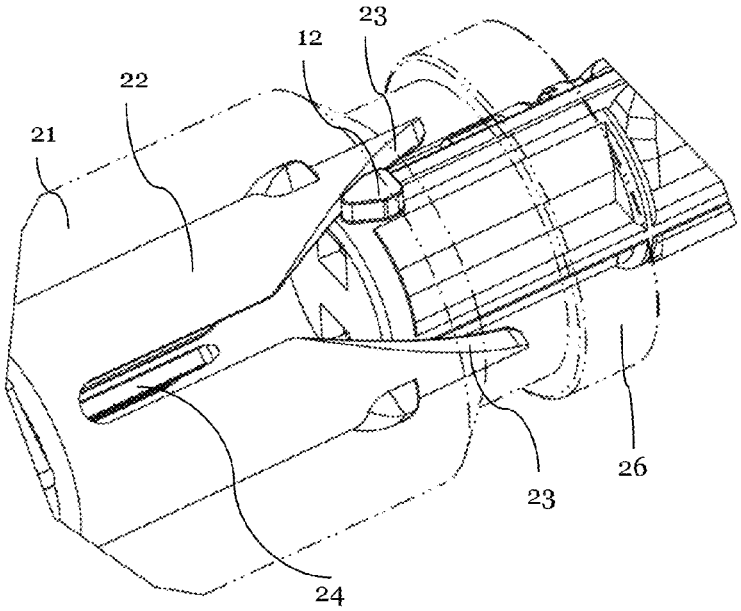

In FIG. 9, the guide element 12 of the plug connector 10 glides along contacting portions 23 of the funnel shaped portion 25 of the guideway 24 of the socket connector's 20 outer casing 22. Thereby, the socket connector 20 is rotated to enable the gliding of the guide element 12 of the plug connector 10 along the contacting portions 23 of the funnel shaped portion 25 of the guideway 24 of the socket connector's 20 outer casing 22. In other words; the orientation of the plug connector 10 remains basically steady and the socket connector rotates inside of the socket connector housing 21 to allow an insertion or "threading in" of the guide element 12 into the guideway 24.

Figure 10:
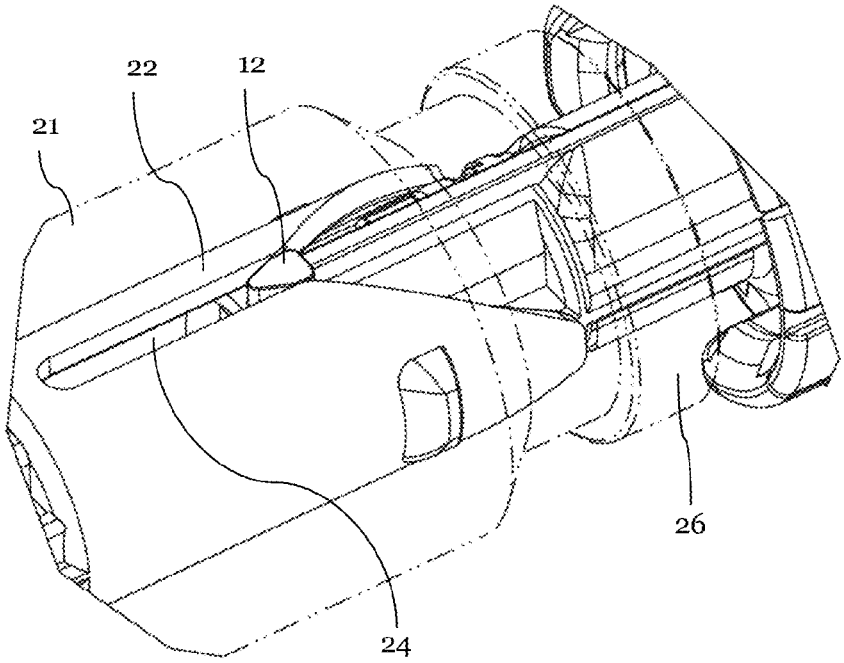

In FIG. 10, the guide element 12 of the plug connector 10 is inserted into the entrance of the guideway 24 of the socket connector's 20 outer casing 22. The rotation of the socket connector 20 in the socket connector housing 21 stops and the guide element 12 of the plug connector 10 is moved into the guideway 24 of the socket connector's 20 outer casing 22. In the position shown in FIG. 10, plug connector 10 and socket connector 20 are now in the correct angular orientation with respect to each other.

Figure 11:
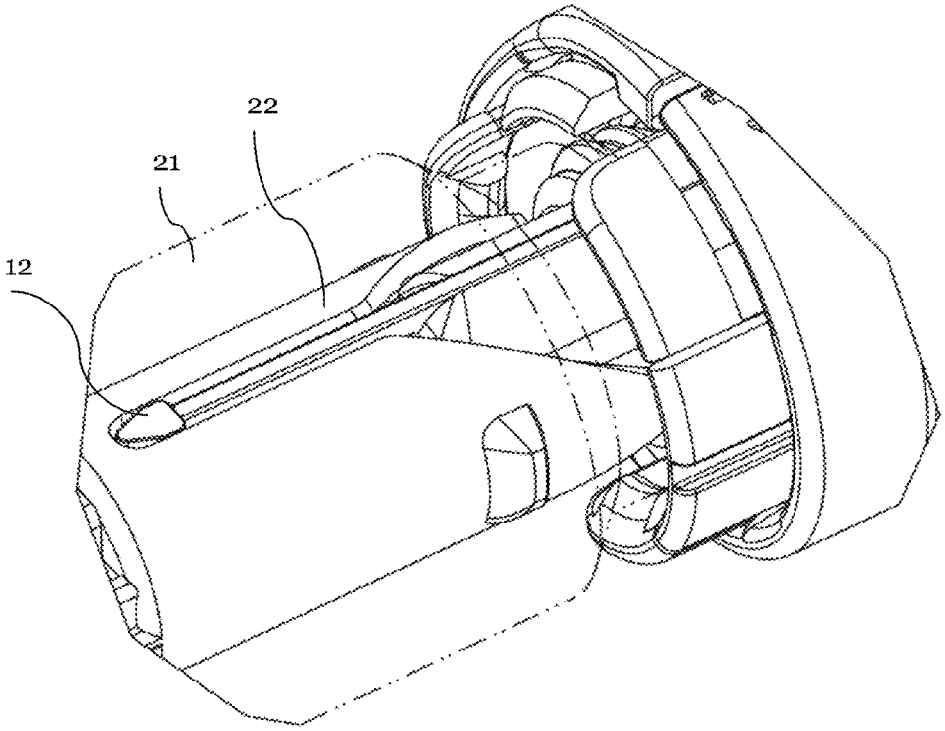

In FIG. 11, the guide element 12 of the plug connector 10 is completely inserted into the guideway 24 of the socket connector's 20 outer casing 22. In this position, plug connector 10 and socket connector 20 are fully and correctly mated with each other.

As also shown in FIGS. 1 to 5 and 7, the connector arrangement is further provided with a connector position assurance (CPA) member which can be inserted into a locked position only if the plug connector 10 is appropriately connected to socket connector 20. In this locked position, the CPA provides additional security for the mated state of plug connector 10 and the socket connector 20, and typically the CPA is constructed such that a user can visibly detect if the CPA is inserted correctly into its locked position.

FIGS. 1 to 5, 7, and 12 to 31 show that the CPA is allocated to the plug connector 10 and comprises a cylindrical outer cap 15 and an inner locking member 17 comprising a locking arm 19. As can be seen best in FIGS. 3 to 5, the cylindrical outer cap 15 comprises cylindrical side walls, an open end and a closed end. Now referring to FIGS. 12 to 31, the socket connector housing 21 comprises a locking projection 26 adapted to interact with the locking arm 19 of the inner locking member 17, to allow a locking of plug connector 10 and socket connector housing 21. The locking projection 26 has a ring shape and the plug connector 10 upon mating is surrounded by the ring shaped locking projection 26.

Figure 12:
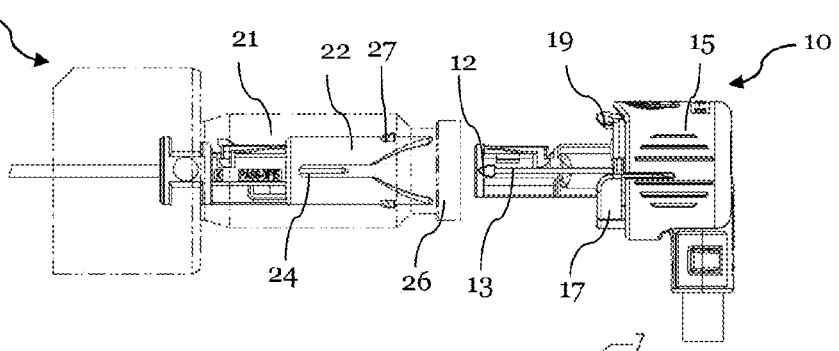
FIGS. 12 to 31 show several views of a course of action concerning a connector position assurance during the insertion of the plug connector into the socket connector.
Figure 13:
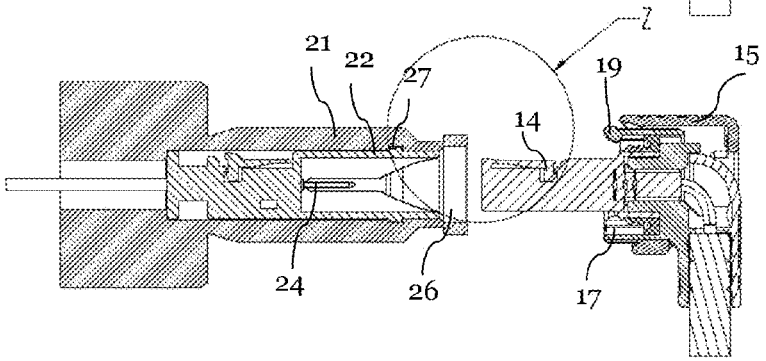
Figure 14:
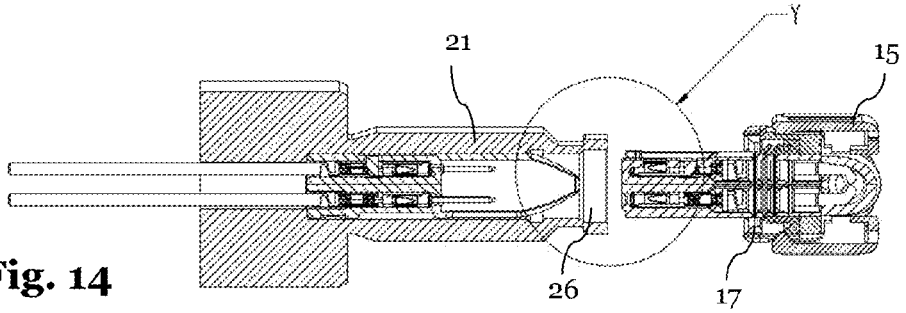
Figure 15:
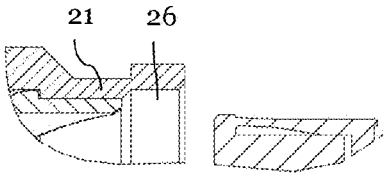
Figure 16:
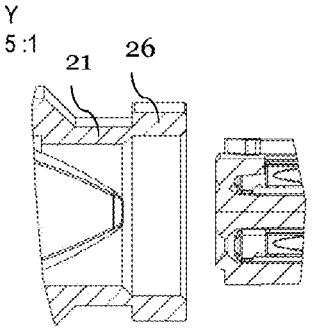

FIG. 12 shows the plug connector 10 and the socket connector 20 before mating. FIGS. 12 to 14 show different views of this position of the plug connector 10 and the socket connector 20. FIGS. 12 and 13 show the two ledges 27 arranged spaced apart on the outer surface of the outer casing 22 of the socket connector 20. As shown in FIGS. 12 and 13, the outer casing 22 is fully inserted into the socket connector housing 21. The two ledges 27 of the outer casing 22 rest in respective recesses, angular grooves, in the socket connector housing 21 and secure thereby a safe connection between the outer casing 22 and the socket connector housing 21, while at the same time allow and guide a rotation of the socket connector 20 inside of the socket connector housing 21. FIG. 13 shows the lever member 14 of the plug connector 10 in its closed position, whereby it fixes the contact terminals in place. FIGS. 15 and 16 show details of the locking projection 26 of the socket connector housing 21 according to FIGS. 13 and 14.

Figure 17:
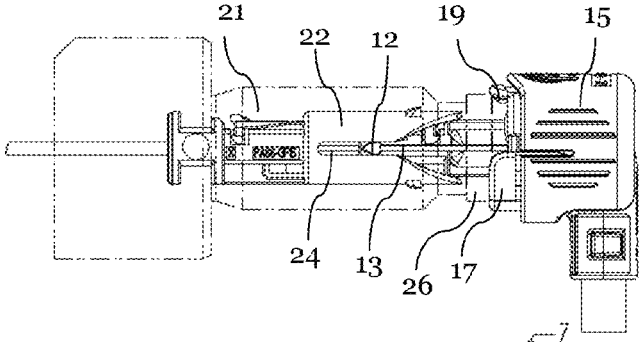
Figure 18:
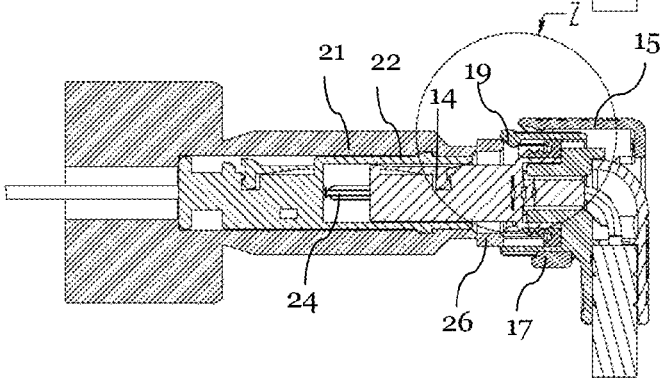
Figure 19:
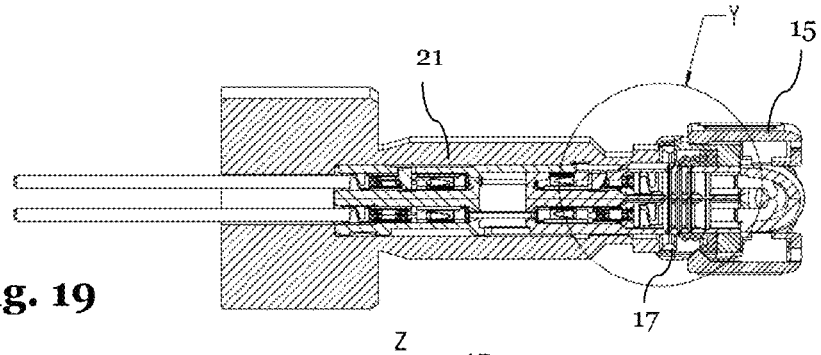
Figure 20:
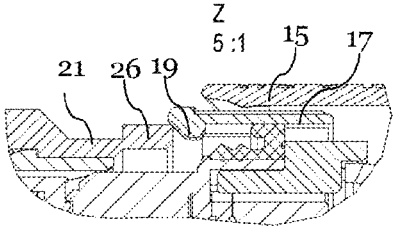
Figure 21:
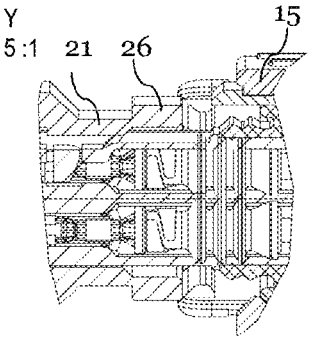

FIGS. 17 to 19 show different views of the insertion of the plug connector 10 into the socket connector 20. The guide element 12 of the plug connector 10 is partially inserted into the guideway 24 of the socket connector's 20 outer casing 22 and the plug connector and socket connector are correctly aligned with respect to each other. Thereby, the correct contacting of the respective contact terminals in plug connector 10 and socket connector is secured. The locking arm 19 of the inner locking member 17 contacts the ring shaped locking projection 26 of the socket connector housing 21 surrounding the plug connector 10. FIGS. 20 and 21 show details of the locking projection 26, of the interaction between the socket connector housing 21 and the locking arm 19 of the inner locking member 17.

Figure 22:
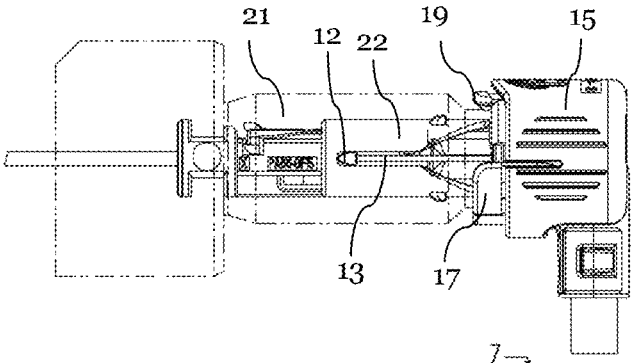
Figure 23:
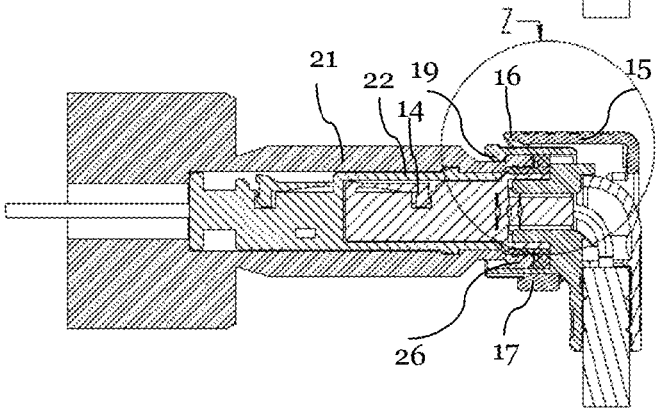
Figure 24:
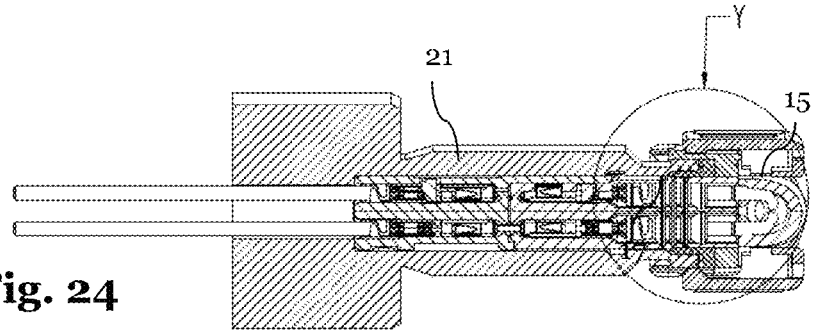
Figure 25:
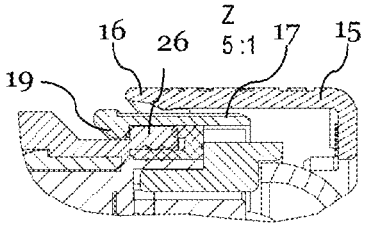
Figure 26:
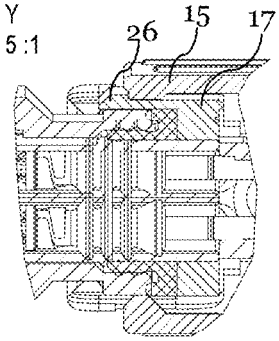

FIGS. 22 to 24 show different views of the completed insertion of the plug connector 10 into the socket connector 20. The guide element 12 of the plug connector 10 is completely inserted into the guideway 24 of the socket connector's 20 outer casing 22. FIG. 23 shows the lever member 14 of the plug connector 10 completely inserted into the outer casing 22 of the socket connector 20. In this position, the lever member 14 additionally secures the position of the contact terminals in plug connector 10. The locking arm 19 of the inner locking member 17 is pressed over the ring shaped locking projection 26 of the socket connector housing 21 and rests in a recess behind the locking projection 26. The outer cap 15 is arranged movable with respect to the inner locking member 17 from a first open position to a second closed position. The outer cap 15 is shown in FIGS. 22 to 26 in the first open position. A latching member 16 of the cylindrical outer cap 15 is visible. FIGS. 25 and 26 show details of the inner locking member 17 resting in the recess behind the locking projection 26 of the socket connector housing 21 according to FIGS. 23 and 24.

Figure 27:
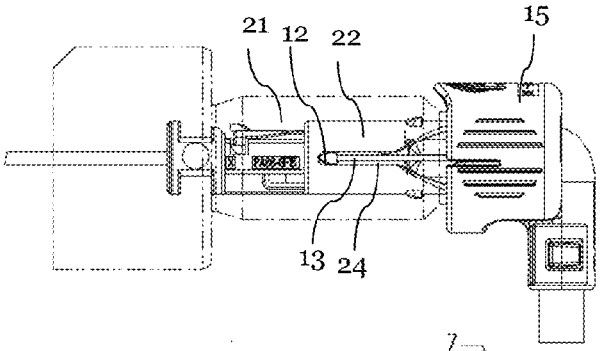
Figure 28:
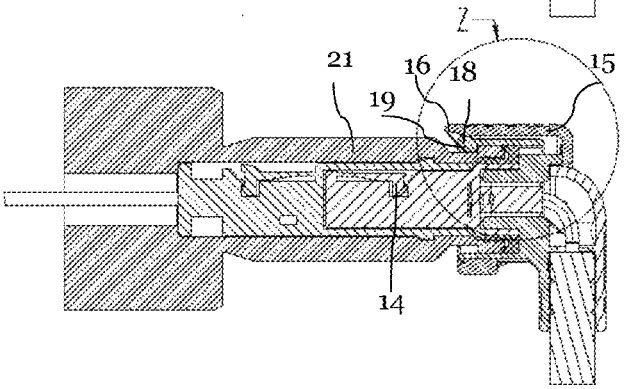
Figure 29:
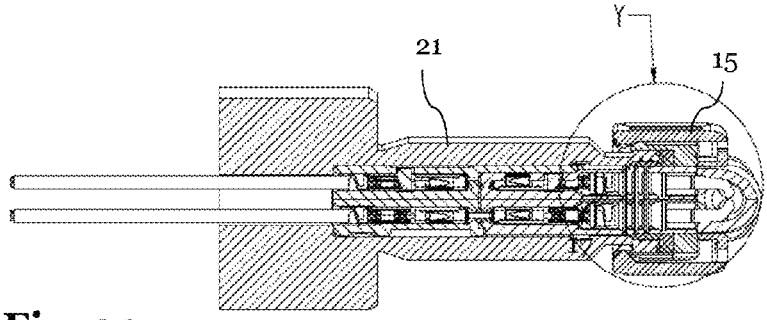
Figure 30:
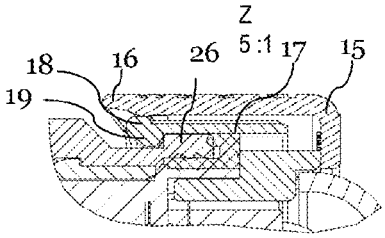
Figure 31:
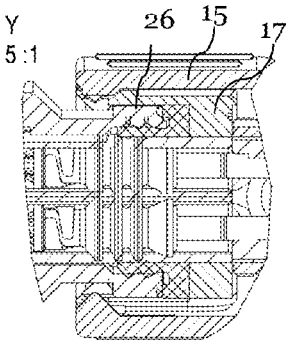

FIGS. 27 to 29 show how the CPA member locks the inner locking member 17 with the socket connector housing 21 in the second closed position of the CPA. In FIGS. 27 to 31 the outer cap 15 is moved with respect to the inner locking member 17 from a first open position to a second closed position after the locking of the inner locking member 17 with the socket connector housing 21. The latching member 16 of the cylindrical outer cap 15 is latched onto a latching portion 18 of the inner locking member 17 when the outer cap 15 is arranged in the shown second closed position. Thereby, a correct and safe mating between the outer cap and the inner locking member can be guaranteed. The plug connector 10 is in locked position still rotatable with respect to the socket connector housing 21. FIGS. 30 and 31 show details of the latching member 16 of the cylindrical outer cap 15 latched onto the latching portion 18 of the inner locking member 17 when the outer cap 15 is arranged in the second closed position according to FIGS. 28 and 29.

The invention claimed is:

1. A connector arrangement, comprising:

a plug connector;

a socket connector, wherein the socket connector is rotatably arrangable in a socket connector housing and comprises an outer casing comprising a guideway formed therein configured to receive a corresponding guide element of the plug connector, wherein the guideway has a funnel shaped portion configured to receive the guide element wherein the guide element rotates the socket connector into a correctly aligned orientation with regard to the plug connector upon contacting said funnel shaped portion when the plug connector is inserted into the socket connector; and a connector position assurance member comprising a cylindrical outer cap and an inner locking member comprising a locking arm, wherein the cylindrical outer cap is movable with respect to the inner locking member from a first open position to a second closed position.

2. The connector arrangement according to claim 1, wherein the cylindrical outer cap is movable to the second closed position after locking of the inner locking member with the socket connector housing, thereby preventing a release of the locking of the inner locking member.

3. The connector arrangement according to claim 1, wherein the cylindrical outer cap comprises a latching member configured to latch onto a latching portion of the inner locking member when the cylindrical outer cap is arranged in said second closed position.

4. The connector arrangement according to claim 1, wherein the cylindrical outer cap comprises cylindrical side walls, an open end, and a closed end.

5. The connector arrangement according to claim 1, wherein the plug connector comprises a lever member to secure the plug connector in the outer casing of the socket connector.

6. The connector arrangement according to claim 1, wherein the outer casing comprises two ledges movable in respective recesses in the socket connector housing to secure a connection between the outer casing and the socket connector housing.

7. The connector arrangement according to claim 1, wherein the funnel shaped portion has screw curve shaped faces.

8. The connector arrangement according to claim 1, wherein the plug connector comprises an essentially cylindrical plug-in portion configured to be inserted into the socket connector.

9. The connector arrangement according to claim 8, wherein the guide element is arranged at a free end of the cylindrical plug-in portion.

10. The connector arrangement according to claim 1, wherein the socket connector housing comprises a locking projection configured to interact with a locking arm of the inner locking member, thereby allowing a locking of the plug connector and the socket connector housing.

11. The connector arrangement according to claim 10, wherein the locking projection has a ring shape and the plug connector is at least partially surrounded by said ring shaped locking projection upon mating with the socket connector.

12. The connector arrangement according to claim 10, wherein the inner locking member allows for a locking onto the socket connector housing in any relative angular orientation of the plug connector and the socket connector housing.

13. The connector arrangement according to claim 10, wherein the locking projection is formed of a circumferentially extending collar.

14. The connector arrangement according to claim 13, wherein the locking projection comprises two circumferentially spaced collar elements.

* * * * *